United States Patent [19]

Jenkins

[11] 4,279,378

[45] Jul. 21, 1981

[54] TOP GAP FOLDING BOX HAVING A TOP CLOSURE INTERLOCK

[75] Inventor: Donald E. Jenkins, Orange, Calif.

[73] Assignee: Willamette Industries, Inc., Portland, Oreg.

[21] Appl. No.: 95,403

[22] Filed: Nov. 19, 1979

[51] Int. Cl.[3] ..... B65D 5/10

[52] U.S. Cl. ..... 229/39 R

[58] Field of Search ..... 229/39 R, 44 R

[56] References Cited

U.S. PATENT DOCUMENTS

| | | | |
|---|---|---|---|
| 2,451,644 | 10/1948 | Wood | 229/39 R |
| 2,614,883 | 10/1952 | Anderson, Jr. et al. | 229/39 R X |
| 2,677,494 | 5/1954 | Buttery | 229/39 R |
| 3,055,570 | 9/1962 | Hamilton | 229/39 R X |
| 3,074,613 | 1/1963 | Cupo | 229/39 R |
| 3,272,421 | 9/1966 | Perry | 229/39 R |
| 3,319,869 | 5/1967 | Ostwald | 229/39 R |
| 3,337,115 | 8/1967 | Jones | 229/39 R |
| 3,580,477 | 5/1971 | Roth | 229/39 R |
| 3,770,187 | 11/1973 | Faires et al. | 229/39 R |
| 4,017,018 | 4/1977 | Pellation | 229/39 R |

*Primary Examiner*—Davis T. Moorhead

*Attorney, Agent, or Firm*—Eugene D. Farley

[57] ABSTRACT

A top gap folding box having four top flaps and a top closure by which the flaps are engaged. Each flap interlocks the adjacent flaps by means of a pair of incisions in the outer edge of the flap which each engage an associated incision in each of the adjacent flaps. The incisions are of a configuration permitting smooth engagement. The material of which the box is made is of a stiff nature, having resistance to bending.

8 Claims, 4 Drawing Figures

TOP GAP FOLDING BOX HAVING A TOP CLOSURE INTERLOCK

BACKGROUND OF THE INVENTION

This invention relates to folding boxes in general, and particularly to a top gap folding box having an interlocking top closure.

Boxes of the class of the present invention are particularly useful in the produce industry where fruit and vegetables are commonly packed by field workers. In the usual practice, the boxes are received at the field in bundles of flattened boxes, each of which must then be squared and have its interlocking bottom folded to produce a useable open top box. The boxes are then filled, and the tops closed for shipping.

Common prior art methods of closing the top of the box involve stapling, gluing, or banding with metal or plastic strapping. These require special equipment in the field and take a substantial amount of time. The equipment is subject to misuse and malfunction. Produce packers have need for a box which may be closed easily and quickly by unskilled workers, and without special equipment.

The interlocking design of the bottom of the box is not feasible for use on the box top since the bottom flaps must be folded into the squared box and then pulled back into their interlocking position to form a rigid bottom. When the box is full of produce, the top flaps cannot likewise be folded into the box.

Accordingly it is the general object of the present invention to provide a top gap folding box having a top closure interlock.

It is a further object of this invention to provide an interlock which can be quickly and easily engaged in the field.

It is a still further object of this invention to provide a folding box having a top closure interlock which is inexpensive to manufacture.

It is another object of this invention to provide a top closure which may be closed without auxiliary machinery.

It is yet another object of this invention to provide an interlock which does not have to be folded inside the container before a lock can be engaged.

BRIEF SUMMARY OF THE INVENTION

In its basic concept, the present invention is a top gap folding box having a top closure interlock including four side walls, a flap attached to the top edge of each of the side walls, each flap having a pair of incisions therein, the incisions being on the outer edge of the flap opposite the edge attained to the side wall, each incision being engageable with an associated incision on the adjacent flap providing an interlock holding the flaps in their closed position covering the box.

DETAILED DESCRIPTION OF THE PREFERRED EMBODIMENT

Figure 1:
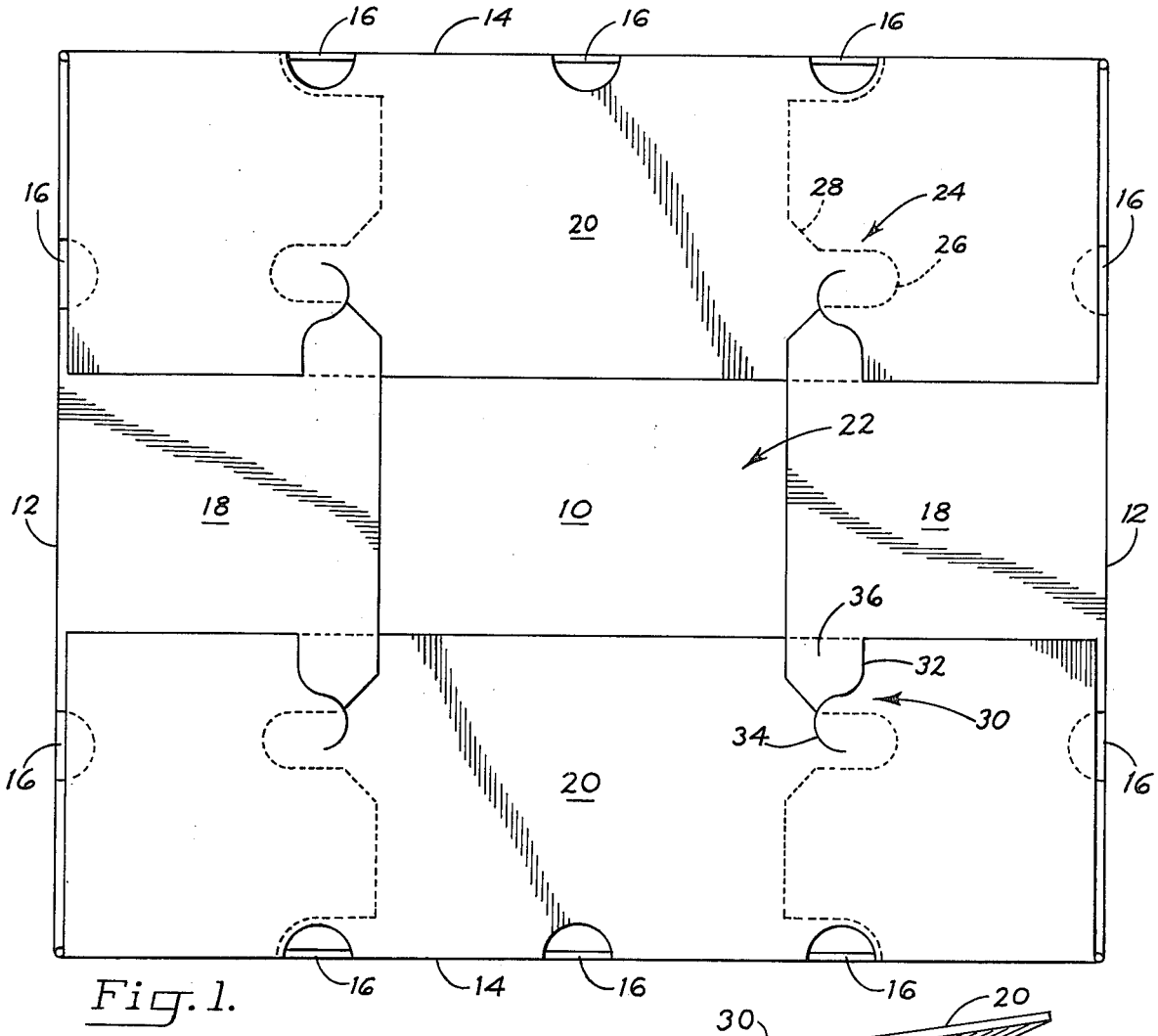
FIG. 1 is a top plan view of the top closure interlock of the present invention in its closed and interlocked position.

The top gap folding box of the present invention, as shown in FIG. 1, comprises a box having a bottom 10, and four side walls, preferably a pair of opposed short side walls 12, and a pair of opposed long side walls 14.

The box is preferably formed out of a material having a substantially stiff nature, providing resistance to bending, such as corrugated cardboard. It may be cut out of a blank sheet of the material and creased for folding in the manner well knwon in the art. As a box specifically designed for produce it will preferably have a plurality of holes 16 therein for ventilation. It may be wax dipped, curtain coated, or left in its natural state, whichever is appropriate for its intended end use.

Hinged to the top of each side wall is a top flap. The flaps attached to the short side walls 12 are minor flaps 18, and the flaps attached to the long side walls 14 are major flaps 20. Opposing flaps are preferably configured similarly. Each pair of flaps is preferably dimensioned so that it does not extend across the entire top of the box, but leaves a top gap 22.

Each minor flap 18 has a pair of first incisions therein on its outer edge, which is the edge opposite the edge hinged to the sidewall, each first incision shown generally at 24. In the preferred embodiment, each first incision comprises a halfoval shaped recess 26, communicating with a notch 28 expanding the mouth of the recess.

Each major flap has a pair of second incisions therein on its outer edge, each second incision shown generally at 30. In the preferred embodiment, each second incision comprises a question mark shaped cut, having a first segment 32 extending inwardly from and substantially perpendicular to the outer edge of the flap, and a second segment 34 attached to the end of the first segment and being inwardly laterally arcuate thereto. The shape of the second incision provides a tab 36 which upon assembling the closure engages the first incision 24. Consequently, there is an interlock formed between minor flap 18 and major flap 20 at each corner.

Although the above is the preferred embodiment of the incisions, it is noted that other configurations thereof are within the scope of the invention. For instance, a straight incision may be employed, located on the outer edge of the flap a distance from the end thereof substantially equal to the depth of the adjacent flap minus the depth of the incision therein. A similar geometrical arrangement is applicable to most incision configurations, including that of the preferred embodiment.

OPERATION

Figure 2:
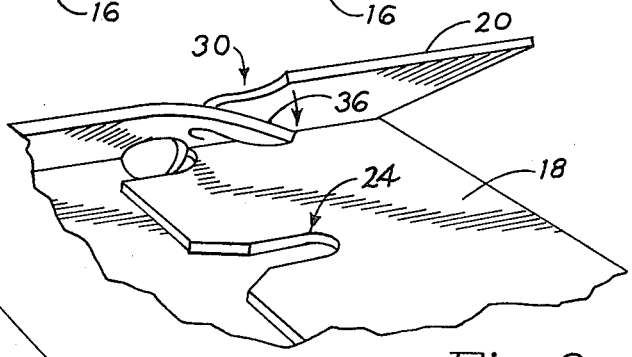
FIGS. 2–4 are fragmentary top perspective views of one corner of the box showing the sequential engagement of the interlock.
Figure 3:
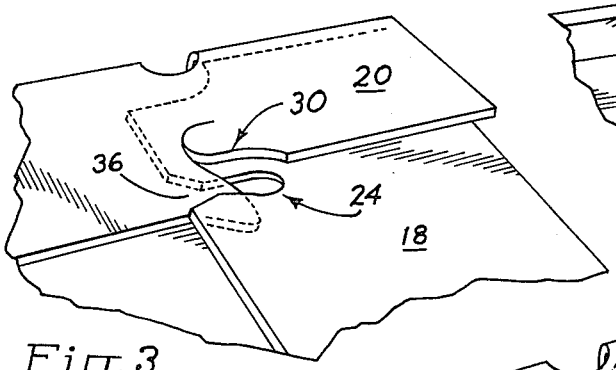
Figure 4:
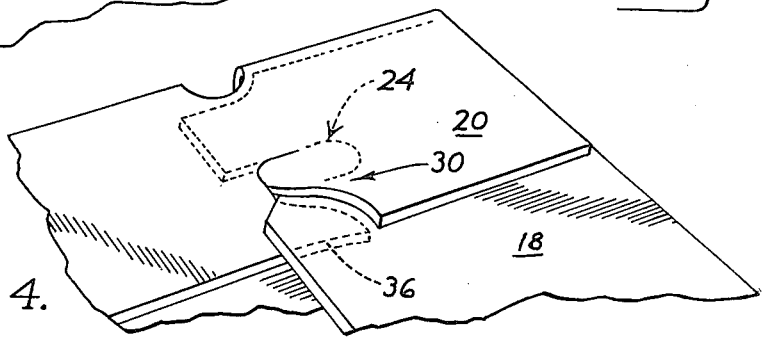

Referring to FIGS. 2–4, the manner of use of the present invention is as follows:

The boxes are received in the field in flattened condition, bound in bundles. Each box is squared, and its interlocking bottom is folded into position. Then the box is filled by the field workers.

When the box is full, the top closure is engaged. This is accomplished by first folding minor flaps 18 over the top of the box. Then major flaps 20 are folded over the box. This leaves top gap 22 in the central portion of the top.

Then, to engage the interlock, each of the tabs 36 on the major flaps is pressed down while the underlying portion of the minor flap is pulled upward (FIG. 2).

Each tab is then inserted through its associated first incision 24 (FIG. 3). When both tabs on one end of the box are likewise engaged, the process is repeated at the other end. An interlock is thus quickly formed on each corner, maintaining the top in closed position (FIG. 4).

Having thus described the present invention in its preferred embodiment, I claim:

1. A top folding box having a bottom, four side walls and a top closure, being integrally formed of stiff sheet material, the top closure comprising a flap hinged to the top edge of each of the side walls, each flap having a pair of incisions therein, the incisions extending from the outer edge of the flap generally toward the edge hinged to the side wall, each incision configured and dimensioned to be engageable with an associated incision on the adjacent flap.

2. The folding box of claim 1 wherein opposing flaps are configured similarly.

3. The folding box of claim 1 wherein each incision is located on the outer edge of the flap a distance from the end thereof substantially equal to the depth of the adjacent flap minus the depth of the associated incision therein.

4. The folding box of claim 1 wherein each pair of opposed flaps extends less than the entire distance across the top of the box, providing a substantial opening therein.

5. A folding box having a bottom, four side walls and a top closure, being integrally formed of stiff sheet material, the top closure comprising a flap hinged to the top edge of each of the side walls, each flap having a pair of incisions therein, the incisions extending from the outer edge of the flap generally toward the edge attached to the side wall, each incision configured and dimensioned to be engageable with an associated incision on the adjacent flap, and wherein each incision in one pair of opposed flaps is formed as a half oval shaped recess, and the incisions in the other pair of opposed flaps are each of question mark configuration, having a first segment extending inwardly substantially perpendicularly to the edge of the flap, and a second segment attached to the first segment, being inwardly laterally arcuate to the first segment.

6. The folding box of claim 6 wherein each incision is located on the outer edge of the flap a distance from the end thereof substantially equal to the depth of the adjacent flap minus the depth of the associated incision therein.

7. The folding box of claim 5 wherein each pair of opposed flaps extends less than the entire distance across the top of the box, providing a substantial opening therein.

8. The folding box of claim 5 wherein the incisions in the one pair of opposed flaps which are formed as half oval shaped recesses each further includes a notch communicating with the recess and expanding the mouth thereof.

* * * * *